US011364539B2

(12) United States Patent
Shendye et al.

(10) Patent No.: US 11,364,539 B2
(45) Date of Patent: Jun. 21, 2022

(54) METHOD AND APPARATUS FOR COUNTER-GRAVITY MOLD FILLING

(71) Applicant: Metal Casting Technology, Inc., Milford, NH (US)

(72) Inventors: Sanjay B. Shendye, Nashua, NH (US); Joseph C. Michalik, Jr., Nashua, NH (US)

(73) Assignee: Metal Casting Technology, Inc., Milford, NH (US)

( * ) Notice: Subject to any disclaimer, the term of this patent is extended or adjusted under 35 U.S.C. 154(b) by 0 days.

(21) Appl. No.: 16/733,348

(22) Filed: Jan. 3, 2020

(65) Prior Publication Data

US 2020/0139430 A1 May 7, 2020

Related U.S. Application Data

(62) Division of application No. 15/618,852, filed on Jun. 9, 2017, now Pat. No. 10,562,095.

(51) Int. Cl.

| | |
|---|---|
| ***B22D 18/06*** | (2006.01) |
| ***B22D 27/04*** | (2006.01) |
| ***B22D 18/04*** | (2006.01) |

(52) U.S. Cl.

CPC ..... *B22D 18/06* (2013.01); *B22D 18/04* (2013.01); *B22D 27/045* (2013.01)

(58) Field of Classification Search

CPC ..... B22D 18/04; B22D 18/06; B22D 27/04; B22D 27/045

USPC ..... 164/63, 65, 256, 257, 258

See application file for complete search history.

(56) References Cited

U.S. PATENT DOCUMENTS

| | | | | |
|---|---|---|---|---|
| 3,863,706 | A | 2/1975 | Chandley et al. | |
| 5,042,561 | A | 8/1991 | Chandley | |
| 5,113,924 | A | 5/1992 | Green et al. | |
| 5,931,214 | A | 8/1999 | Spicer et al. | |
| 6,004,368 | A | 12/1999 | Chandley et al. | |
| 6,148,899 | A | 11/2000 | Cornie et al. | |
| 6,640,877 | B2 * | 11/2003 | Soderstrom et al. | B22C 1/02 164/119 |
| 6,684,934 | B1 | 2/2004 | Cargill et al. | |
| 10,562,095 | B2 * | 2/2020 | Shendye et al. | B22D 18/04 |
| 2001/0019187 | A1 | 9/2001 | Booth et al. | |
| 2001/0050942 | A1 | 12/2001 | Soderstrom et al. | |
| 2003/0234092 | A1 | 12/2003 | Brinegar | |

FOREIGN PATENT DOCUMENTS

| | | | |
|---|---|---|---|
| CN | 1739889 | A | 3/2006 |
| CN | 101168189 | A | 4/2008 |
| CN | 101722289 | A | 6/2010 |
| CN | 104726933 | A | 6/2015 |
| JP | 8-224655 | A | 9/1996 |

(Continued)

*Primary Examiner* — Kevin P Kerns
(74) *Attorney, Agent, or Firm* — BakerHostetler

(57) ABSTRACT

A counter-gravity casting method and apparatus in which the mold is held stationary and the crucible is moved generally laterally from a melt chamber to a fill chamber positioned below the mold with respect to gravity. A casting chamber is located generally above the fill chamber with respect to gravity. The method and apparatus utilize separate chambers for melting and casting in which the pressure in each chamber can be varied relative to each other in order to introduce molten metal into the mold.

7 Claims, 11 Drawing Sheets

(56) References Cited

FOREIGN PATENT DOCUMENTS

| | | | |
|---|---|---|---|
| JP | 2003311390 | A | 11/2003 |
| JP | 2003534136 | A | 11/2003 |
| JP | 200425308 | A | 1/2004 |
| JP | 2008254039 | A | 10/2008 |
| KR | 20030016273 | A | 2/2003 |
| KR | 20050036082 | A | 4/2005 |

* cited by examiner

METHOD AND APPARATUS FOR COUNTER-GRAVITY MOLD FILLING

CROSS-REFERENCE TO RELATED APPLICATIONS

This application claims benefit of and is a divisional of U.S. patent application Ser. No. 15/618,852, filed Jun. 9, 2017, entitled "Method and Apparatus for Counter-Gravity Mold Filling," now U.S. Pat. No. 10,562,095, issued Feb. 18, 2020, which is hereby incorporated by reference in its entirety.

TECHNICAL FIELD

This patent disclosure relates generally to methods and apparatus for metal casting. More particularly, this patent disclosure relates to counter-gravity casting apparatus and methods. Further, this patent disclosure relates to the use of counter-gravity casting apparatus and methods for producing castings using single crystal (SX), directionally solidification (DS) and equiaxed polycrystalline methods.

BACKGROUND

Alloys, such as high rhenium containing alloys, used for casting single crystal, directionally solidified parts can be very expensive. In conventional art casting systems, molten alloy is introduced to the mold by pouring or injecting the alloy from the top into a sprue passage. To minimize defects in cast parts caused by shrinkage during solidification, directional solidification can be employed wherein the shrinkage that forms in solidified portions of the part are filled with alloy from a portion of the part that has not yet solidified and with molten alloy in the sprue replenishing any material used to fill the shrinkage. In these conventional casting systems, alloy solidifies in the sprue and must be removed from the finished parts and scrapped or recycled.

For high cost alloys it is advantageous to minimize or reduce the material remaining in the sprue following the casting process. A counter-gravity process that addresses this need was first developed by Hitchiner Manufacturing Company and disclosed in U.S. Pat. No. 3,863,706, the disclosure of which is incorporated in its entirety by reference herein. In the counter-gravity process disclosed in that patent, the sprue is filled from the bottom and, following solidification of the cast parts, any molten metal in the sprue is allowed to drain down and be recaptured for subsequent casting processes thereby reducing the overall cost per cast part. Further reductions in cost per part can be achieved by reducing cycle time for casting.

While counter-gravity mold filling processes and methods are an improvement over conventional casting methods and apparatus, the equipment for performing these processes has heretofore been oriented vertically and can extend upwards of 40 feet or more. Because of this, these processes can only be performed in suitable locations having extended vertical space or in locations in which a pit has been created for containing a portion of the equipment.

Improvements are therefore still needed to improve efficiency, reduce cost, allow use of the processes in a broader selection of locations and to allow use of these methods and apparatus to be used in single crystal casting.

SUMMARY

The foregoing needs are met, to a great extent, by the present disclosure, wherein aspects of an improved counter-gravity mold filling method and apparatus are provided.

In one aspect, the methods and apparatus of the present disclosure utilize counter-gravity molding to reduce the alloy that solidifies in the sprue of a casting. The methods and apparatus of the present disclosure also provide for directional solidification of counter-gravity castings with reduced vibrations of the mold during solidification thereby reducing spurious grain growth during single crystal casting. According to an aspect of the disclosure, a counter-gravity casting method is provided in which the mold is maintained stationary during casting and directional solidification. The method includes the steps of melting metal in a crucible in a melt chamber and then moving the crucible from the melt chamber to a casting chamber. Moving the crucible from a melt position to a casting position includes moving the crucible laterally from a melt chamber to a fill chamber and bringing the molten metal into contact with a fill pipe. The crucible is then moved to bring the molten metal in contact with a fill pipe. The molten metal is introduced upward through the fill pipe and into the mold. Molten metal is then drained from the fill tube back to the crucible and the crucible is moved away from the fill pipe. A susceptor is then moved in relation to the mold to cause directional solidification of the molten metal in the mold. This process is well-suited for casting highly reactive SX/DS alloys.

In another aspect of the disclosure, a counter-gravity casting method is provided in which the mold is maintained stationary during casting and solidification. The method includes the steps of melting metal in a crucible in a melt chamber and then moving the crucible from the melt chamber to a casting chamber. The crucible is then moved to bring the molten metal in contact with a fill pipe. The molten metal is introduced upward through the fill pipe and into the mold. Molten metal is then drained from the fill tube back to the crucible and the crucible is moved away from the fill pipe. A susceptor is then moved in relation to the mold to cause equiaxed polycrystalline solidification of the molten metal in the mold. This process is well suited for casting superalloys, in addition to other alloys.

In another aspect of the disclosure, a counter-gravity casting apparatus is provided having a melt chamber, a fill chamber adjacent to and displaced generally lateral to the melt chamber with respect to gravity and a casting chamber positioned generally above the fill chamber with respect to gravity. A fill pipe is positioned within the fill chamber and a plunger is positioned to secure in position a mold placed in the casting chamber.

DETAILED DESCRIPTION

Figure 1:
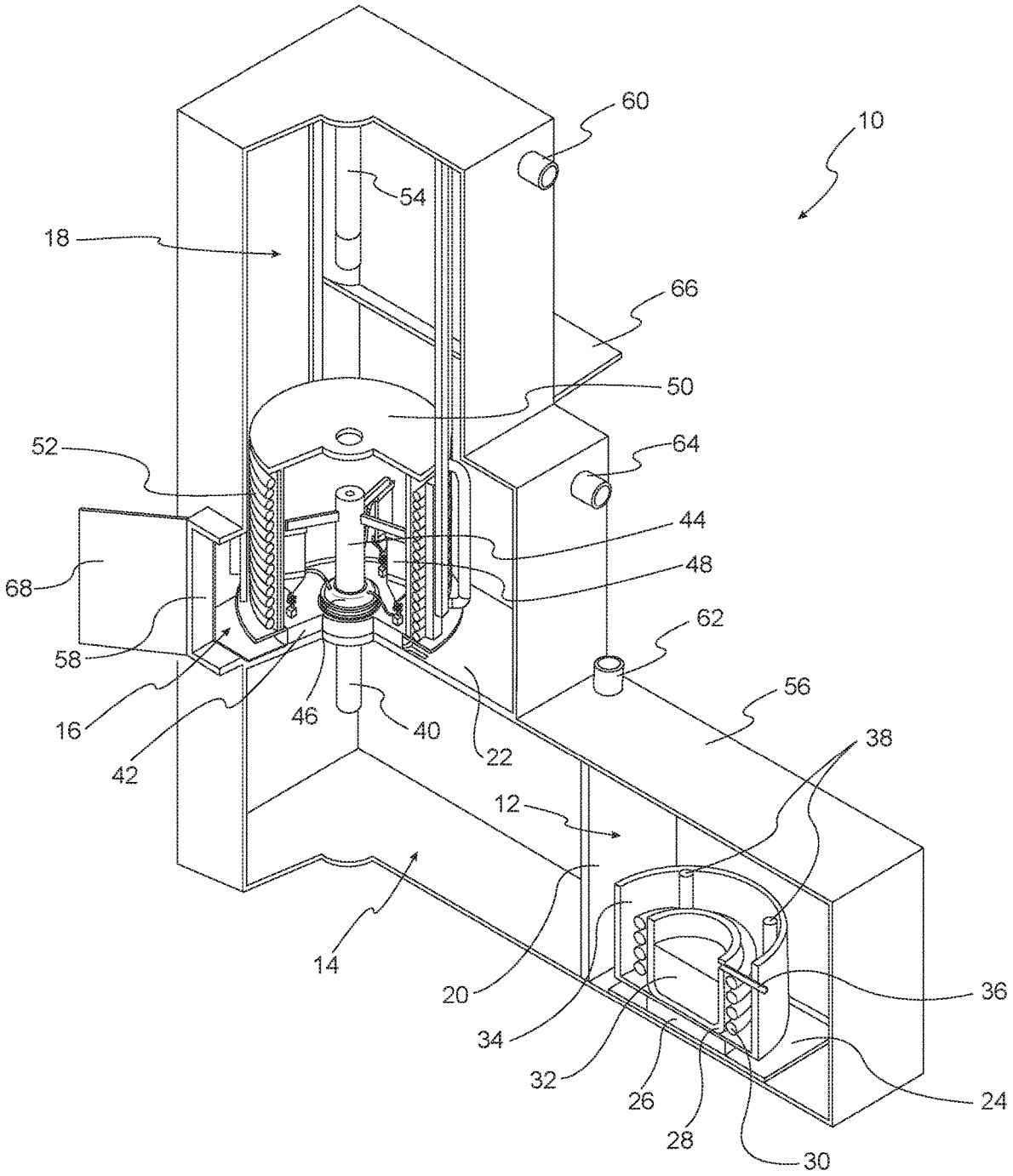
FIG. 1 is a partial cut-away perspective view of a counter-gravity casting apparatus depicting the initial position of a crucible, susceptor, and plunger prior to performance of a casting operation in accordance with a first aspect of the disclosure.

Now referring to the drawings, wherein like reference numerals refer to like elements throughout, there is illustrated in FIG. 1 a counter-gravity casting apparatus 10 in accordance with a first aspect of the present disclosure. The counter-gravity casting apparatus is comprised of four main chambers: a melt chamber 12; a fill chamber 14 located generally lateral to the melt chamber with respect to gravity; a casting chamber 16 located adjacent to the fill chamber and generally above the fill chamber with respect to gravity; and a susceptor chamber 18 located generally above the casting chamber with respect to gravity. As will be described below, a moveable interlock 20 is provided in order to separate the melt chamber 12 from the fill chamber 14 during different phases of the casting process. One function of the interlock 20 is insulation of the melt chamber 12 during the melting process. The fill chamber 14 is separated from the casting chamber 16 by a base plate 22 which allows pressure differential to be created between the fill chamber 14 and casting chamber 16 as will be described below.

As depicted, the counter-gravity casting apparatus 10 includes a carriage 24 that translates between the melt chamber 12 and the fill chamber 14. Coupled to the carriage 24 is a lift 26 for raising and lowering a crucible 28 provided thereon. The crucible 28 is preferably a ceramic crucible made of a material such as alumina. A melt coil 30 surrounds the crucible 28 to heat the crucible and melt a casting alloy placed in the crucible to generate the molten metal 32 for casting. An enclosure 34 surrounds the crucible 28 so that, as will be described below, the pressure within the enclosure 34 can be increased or decreased through inlet 36. Guide rods 38 affixed to the carriage 24 guide the enclosure 34 and crucible 28 as they are raised.

As depicted in FIG. 1, the fill chamber includes a fill pipe 40. As also depicted in FIG. 1, the casting chamber 16 includes a chill plate 42 placed on top of the base plate 22 to promote directional solidification. In a preferred aspect of the disclosure, the chill plate 42 is a water cooled chill plate made of copper or such other heat conducting material. A center sprue 44 sits on top of the fill pipe 40 and the center sprue 44 and fill pipe 40 are connected through the chill plate 42 and base plate 22. Ceramic mount and seals 46 are provided to allow the center sprue 44 to be sealably mounted between the fill chamber 14 and casting chamber 16 so that the pressure in the fill chamber 14 can be varied relative to the pressure in the casting chamber 16.

One or more molds 48 are fluidly connected to the central sprue to allow counter-gravity casting using one or more components and methods described below. In one aspect of the disclosure, the molds 48 have a cylindrical center sprue 44 and the parts to be cast are assembled on the sprue with an appropriate crystal selector. In the case of certain single crystal part geometries, the grain selector is a crystal with known orientation.

Surrounding the central sprue 44 and mold cavity 48 is a susceptor 50 that is wrapped with susceptor coil 52. The susceptor 50 can be made of any suitable material such as graphite. The susceptor 50 is depicted with a hole in the top above which is a plunger 54, the function of which will be discussed below. Surrounding the counter-gravity filling apparatus 10, and forming the melt chamber 12, fill chamber 14, casting chamber 16 and susceptor chamber 18 is a housing 56. Provided in the housing is a doorway 58 for inserting and removing molds 48 and for sealing the casting chamber in certain aspects of the disclosure. Also provided in the housing are inlets 60, 62, 64 for introducing or removing gas from the chambers.

Figure 2:
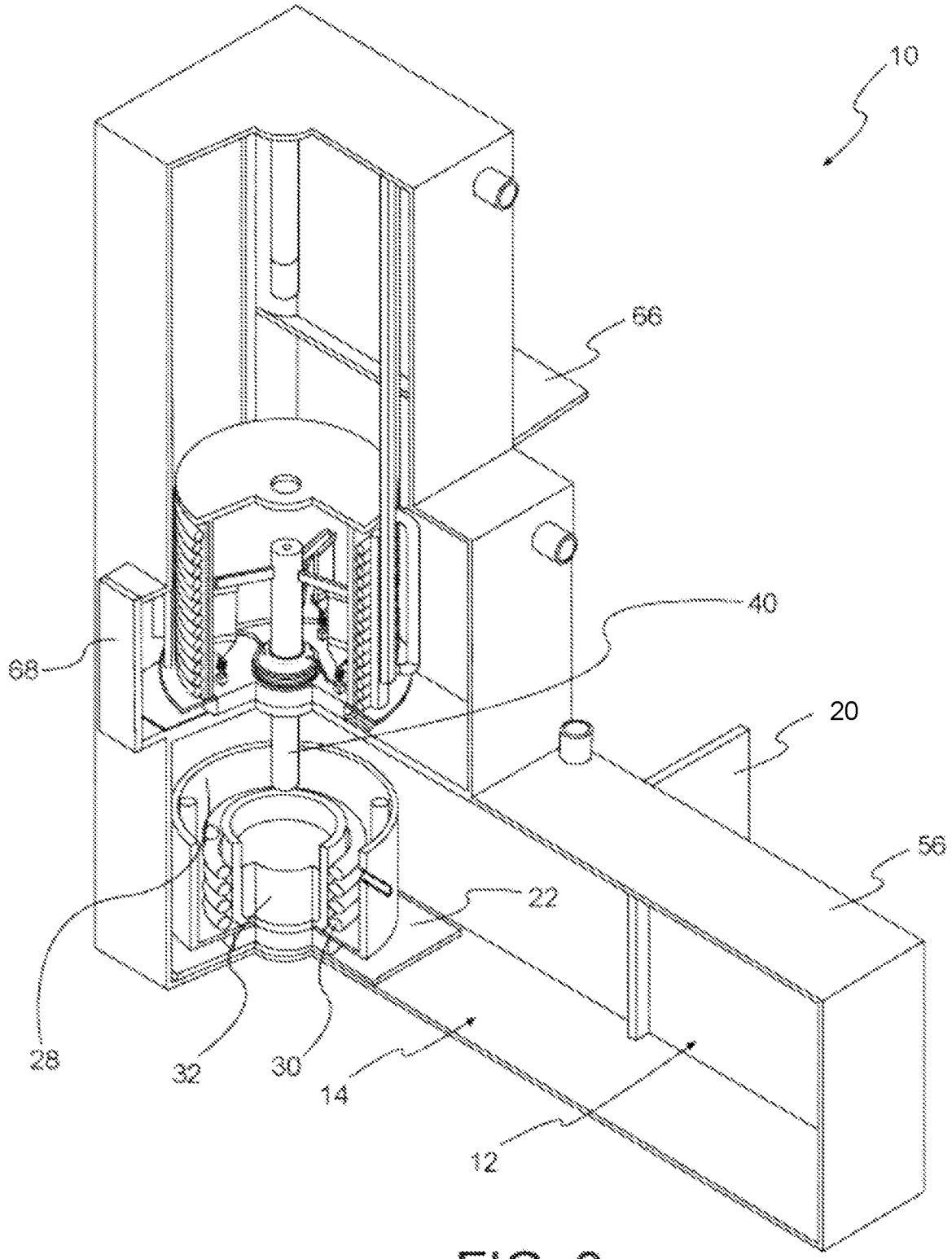
FIG. 2 is a partial cut-away perspective view of the counter-gravity casting apparatus of FIG. 1 depicting the crucible in an intermediate position prior to performing a casting operation.

A method of operation of the counter-gravity casting apparatus 10 will now be described with reference to FIGS. 1 through 11. As depicted in FIG. 1, the crucible 28 begins in the melt chamber 12 where the melt coil 30 heats the crucible to generate molten metal 32 for casting. When the metal is melted, the interlock 20 is opened to allow the carriage 24 to translate into the fill chamber 14, as shown in FIG. 2. Although not depicted, it will be readily recognized that the interlock 20 can be opened by rotating on hinges or passed through a opening in the housing 56. When the crucible 28 is in the fill chamber, the crucible 28 is aligned below the fill pipe 40.

Figure 3:
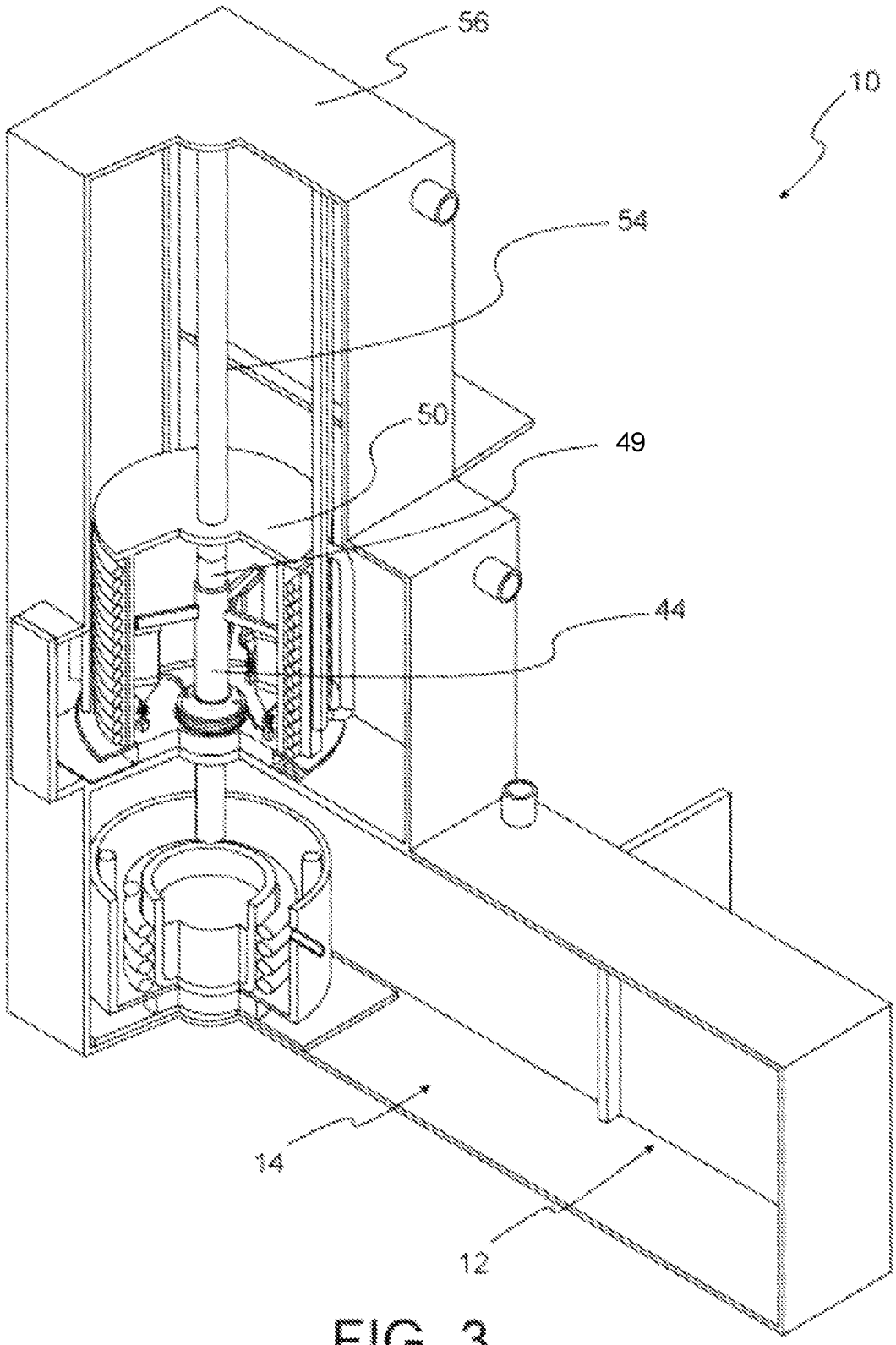
FIG. 3 is a partial cut-away perspective view of the counter-gravity casting apparatus of FIG. 1 depicting the plunger in position for performing a casting operation.

As depicted in FIG. 3, the plunger 54 is extended downward and passes through a hole in the susceptor 50 and rests on top of the central sprue 44 securing the central sprue 44 and mold 48. In this way, the mold is held stationary during the casting and cooling processes by the plunger 54. The plunger 54 includes a ceramic end portion 49 to withstand the heat of the molten metal in the central sprue 44 and susceptor 50. Although not shown, it will be readily recognized that the plunger 54 can be a telescoping piston ram that extends downward through an opening in the top of the housing 56 with the hydraulic actuator secured on top of the housing 56.

Figure 4:
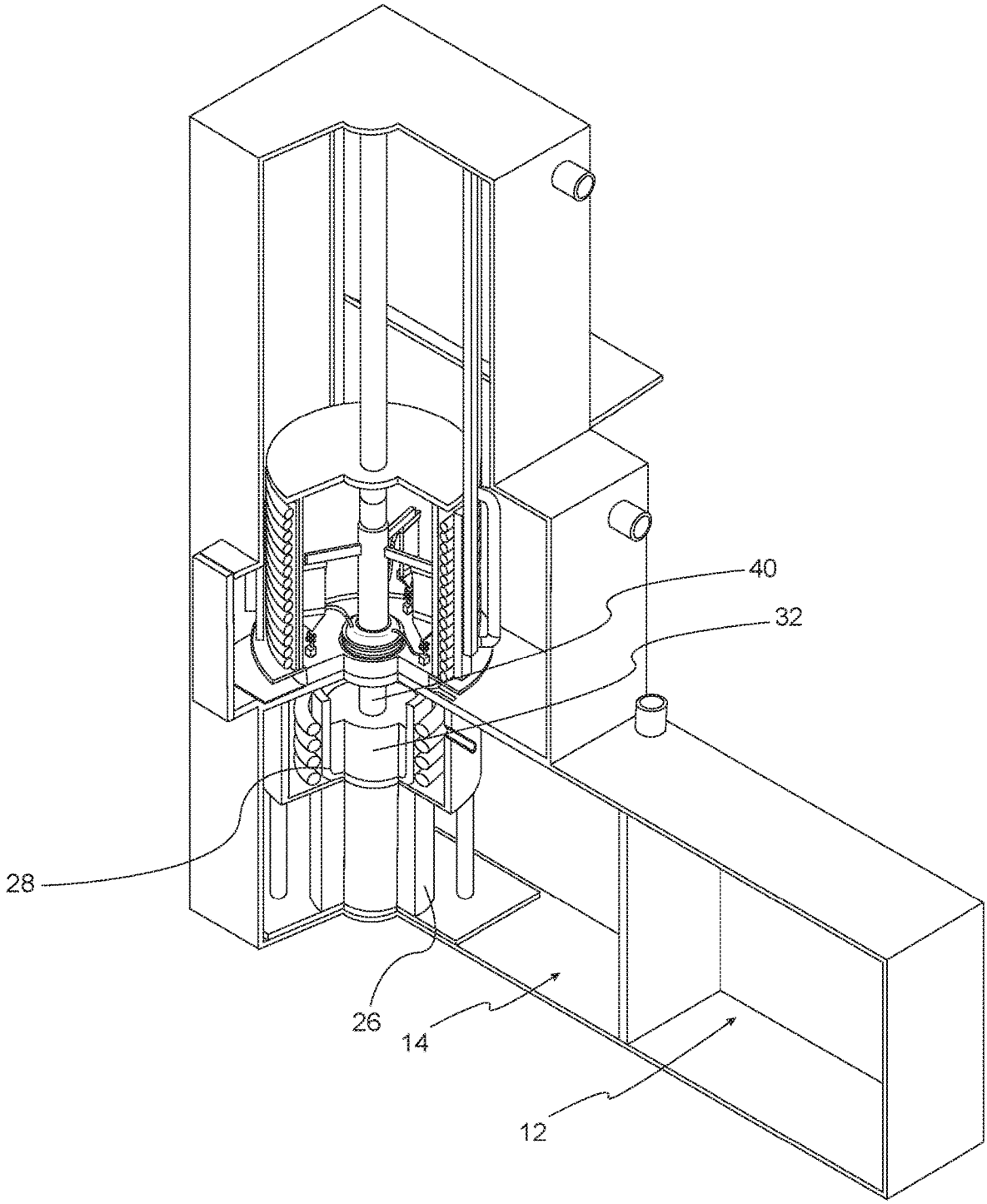
FIG. 4 is a partial cut-away perspective view of the counter-gravity casting apparatus of FIG. 1 depicting the crucible in position for performing a casting operation.

As depicted in FIG. 4, the crucible 28 is moved laterally from the melt chamber 12 to the fill chamber 14 with the crucible passing below the fill pipe 40. The crucible 28 is raised by lift 26 to bring the molten metal 32 into contact with the fill pipe 40 and to bring the top lip of the crucible 28 in sealing contact with an o-ring (not shown) on the bottom of the base plate 22. It will be readily understood that providing for minimal clearance between the bottom of the fill pipe 40 and the crucible enclosure 34, as the crucible 28 is moved laterally below the fill pipe, will allow for the overall height of the apparatus 10 to be reduced. In a preferred aspect of the disclosure, the clearance between the fill pipe 40 and the crucible enclosure 34 is less than one third the height of the enclosure. In this preferred disclosure there is no requirement for a pit as in the standard practice of casting single crystal/directionally solidified molds. This reduces the overall height of the equipment. A pressure differential is then created between the fill chamber 14 and the casting chamber 16 by pressurizing the fill chamber 14 through inlet 62, creating a vacuum in the casting chamber 16 through inlet 60, or a combination thereof. As will be readily recognized, the pressure in the fill chamber 14 must be higher than the pressure in the casting chamber 16 to cause the molten metal to be introduced upward through the fill pipe 40 and into the mold.

Figure 5:
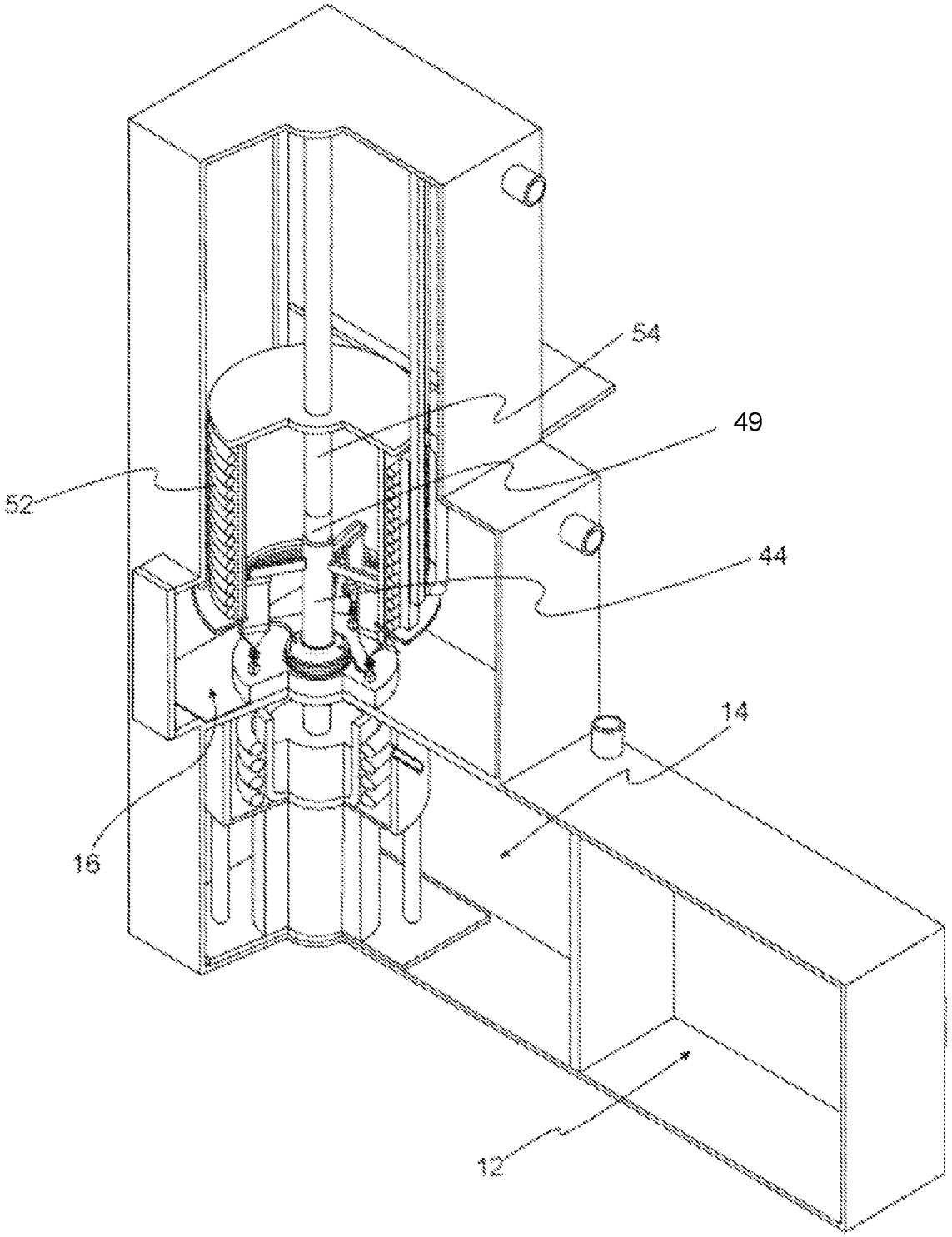
FIG. 5 is a partial cut-away perspective view of the counter-gravity casting apparatus of FIG. 1 depicting the susceptor in a partially raised position during performance of a casting operation.
Figure 6:
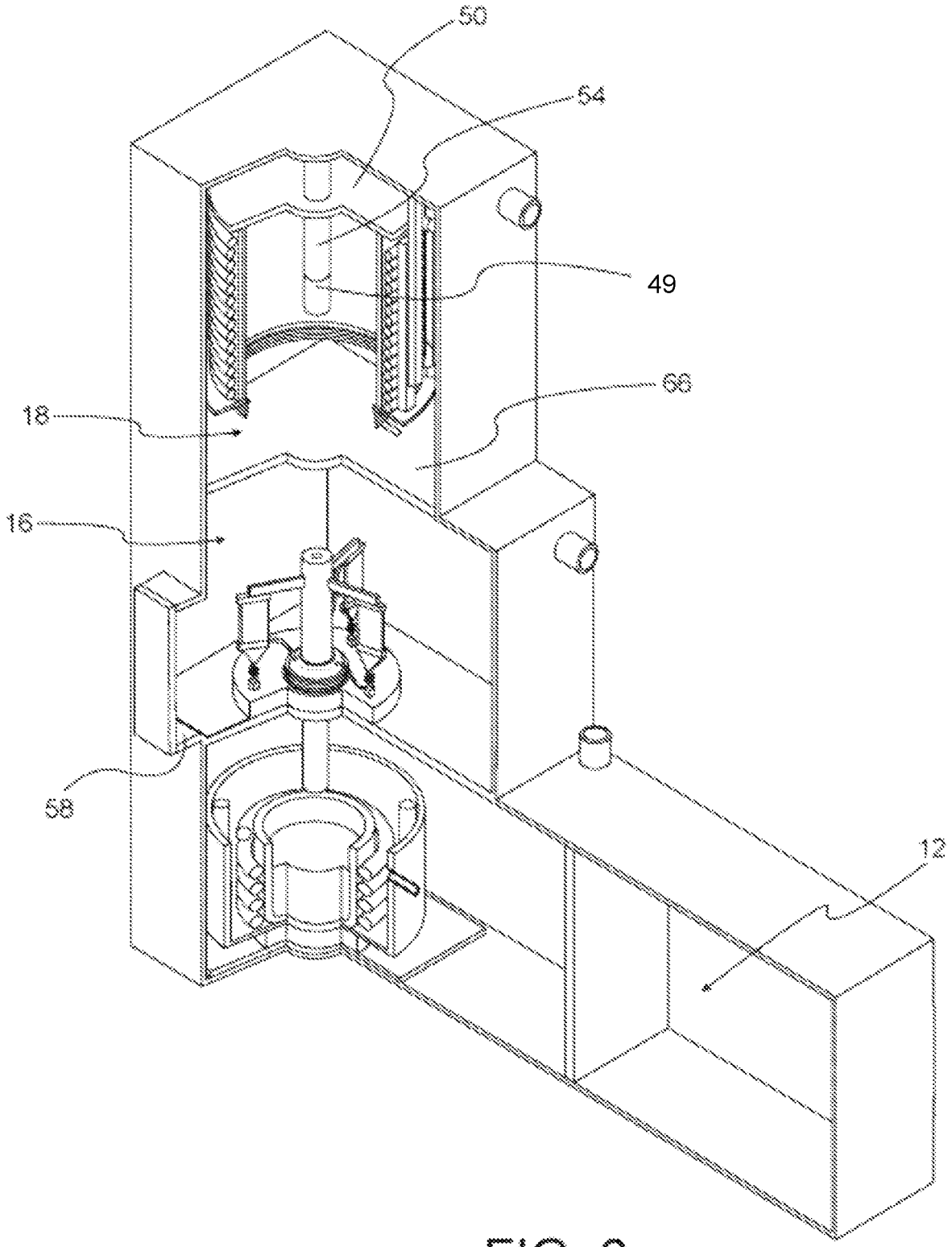
FIG. 6 is a partial cut-away perspective view of the counter-gravity casting apparatus of FIG. 1 depicting the susceptor and plunger in a fully raised position, and the crucible in an intermediate position, following performance of a casting operation.
Figure 7:
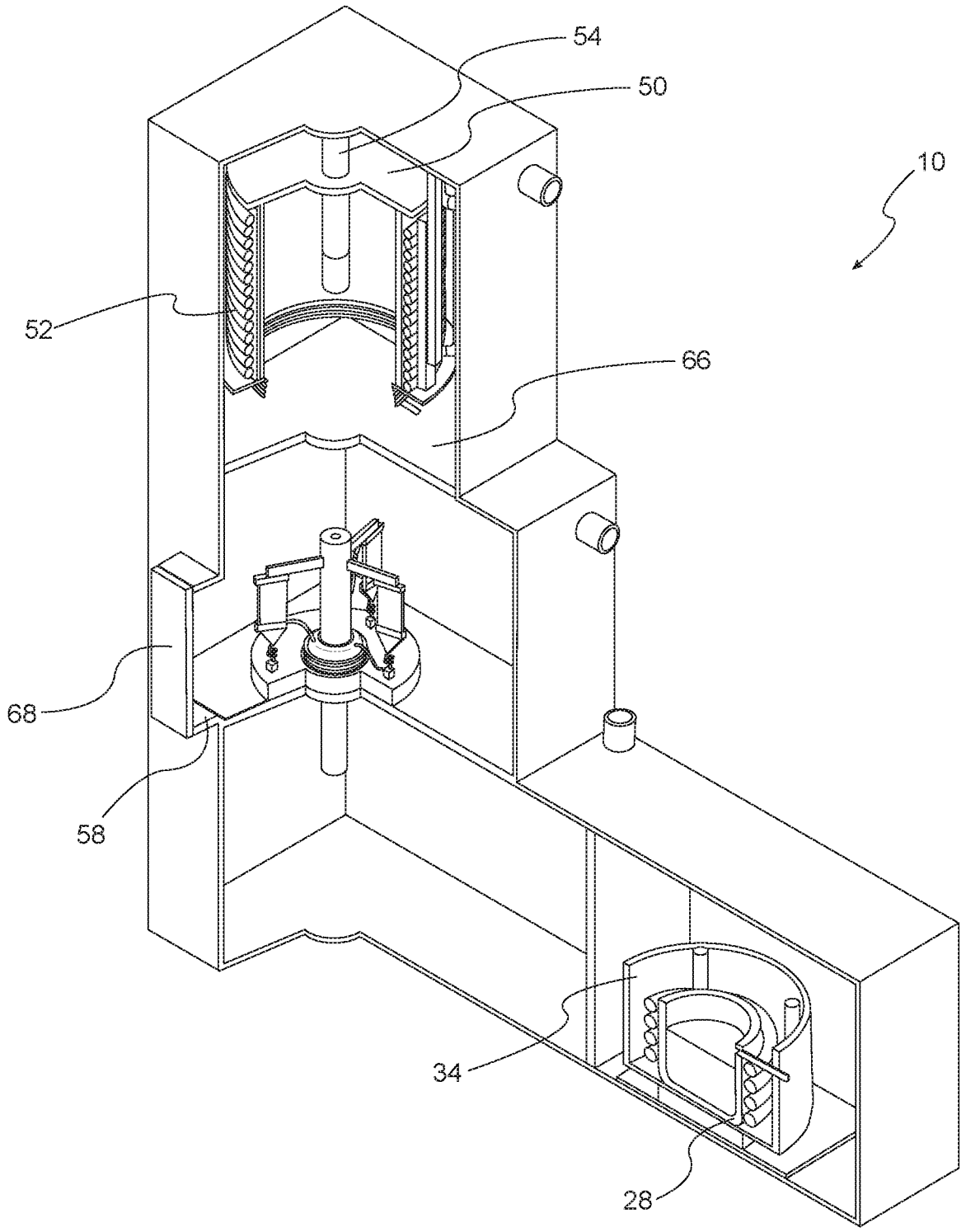
FIG. 7 is a partial cut-away perspective view of the counter-gravity casting apparatus of FIG. 1 depicting the crucible returned to its initial position for recharging the crucible with metal for casting.
Figure 8:
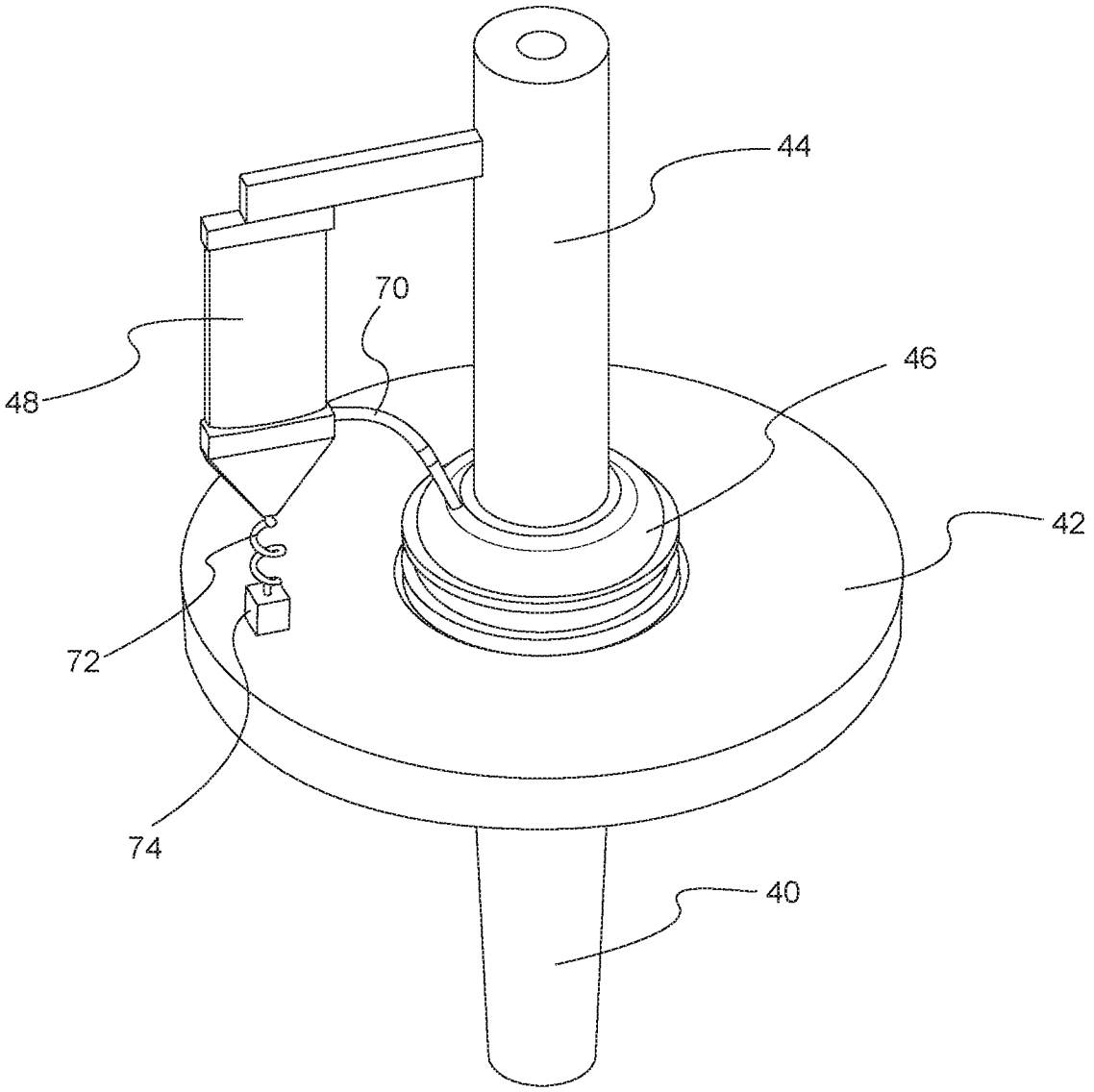
FIG. 8 is a perspective view of a mold for use in the counter-gravity casting apparatus of FIG. 1 in accordance with a first aspect of the disclosure.

As depicted in FIG. 5, after the mold is filled, and after a certain portion of the grain selector is solidified, the pressure differential between the fill chamber 14 and casting chamber 16 is reduced to allow molten metal remaining in the central sprue 44 to drain back into the crucible 28. As depicted in FIG. 6, the plunger 54 is then retracted. The crucible 28 is lowered so that it can be moved back to the casting chamber 16 as is depicted in FIG. 7 so that it can be replenished with alloy. The susceptor 50 and susceptor coil 52 are then raised into the susceptor chamber 18 to allow cooling of the casting. An interlock 66 is shut to close off the casting chamber 16 from the susceptor chamber 18 to minimize cooling of the susceptor 50 while the casting cools and is removed from the casting chamber 16.

As will be readily understood, the interlock 66 can be provided in two or more sections with a partial recess in each to allow the interlock to be closed around the plunger 54 to seal the casting chamber 16 from the susceptor chamber 18. This arrangement allows the pressure between the fill chamber 14, the casting chamber 16, and the susceptor chamber 18 to be separately controlled via the independent inlets 62, 64, 60, respectively.

The crucible 28 is lowered and moved back to the melt chamber 12 as depicted in FIG. 7 to be replenished with alloy. As will be readily recognized, the rate at which the susceptor 50 and susceptor coil 52 are raised is determined by the alloy being cast and is selected to achieve directional solidification. As will be readily recognized, raising the susceptor 50 and susceptor coil 52 can be accomplished by any conventional means including interlocking the susceptor 50 to the plunger 54 or providing a separate piston secured to the susceptor. In a preferred aspect, the plunger 54 includes an inner telescoping ram that passes through the hole in the susceptor 50 to rest on top of the central sprue 44. A second ram in the form of an outer sleeve of the plunger 54 engages with the susceptor 50 and is used to raise the susceptor 50.

As depicted in FIG. 7, when the susceptor 50 is fully raised and the desired directional solidification achieved, allowing access to the mold 48 through the doorway 58 for removal from the counter-gravity casting apparatus 10. The doorway 58 is provided with a door 68 that can be sealed to allow pressurization of the casting chamber 16 during the casting process.

Four preferred mechanisms for introducing the molten metal into the mold 48 are also depicted in FIGS. 8-11. In a first mechanism, depicted in FIG. 8, molten metal is introduced through a tube 70 that is fluidly connected to the fill tube 40 through a seat portion 46 of the center sprue 44. Molten metal is drawn through the fill tube 70 directly into the mold 48. A grain selector 72 is provided at the bottom of the mold 48 and connected to a grain selector block 74, that sits on chill plate 42, to allow a fluid connection between the mold 48 and the grain selector block 74 for directional solidification of a single crystal. A reduction in inclusions can be achieved by bottom filling the mold in a non-turbulent fashion in the foregoing manner.

Figure 9:
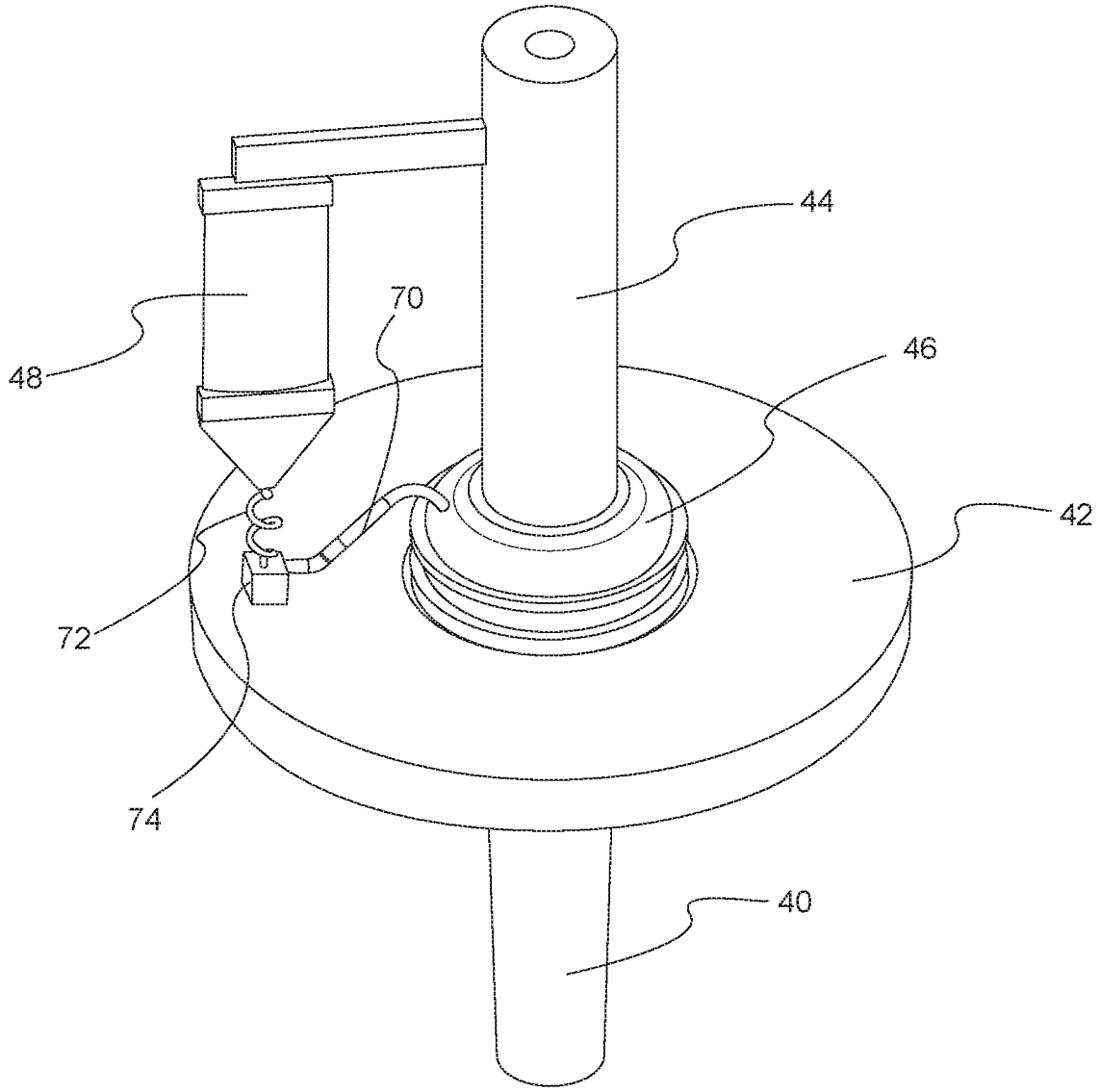
FIG. 9 is a perspective view of a mold for use in the counter-gravity casting apparatus of FIG. 1 in accordance with an alternative aspect of the disclosure.

In an alternate mechanism shown in FIG. 9, the molten metal is drawn through the fill tube 70 into a grain selector block 74. A grain selector 72 is provided at the bottom of the mold 48 and connected to a grain block 74 that sits on chill plate 42, to allow a fluid connection between the mold 48 and the grain selector block 74 for directional solidification of a single crystal. In this embodiment, the mold 48 is filled with molten alloy passing through the grain selection block 74 and grain selector 72.

Figure 10:
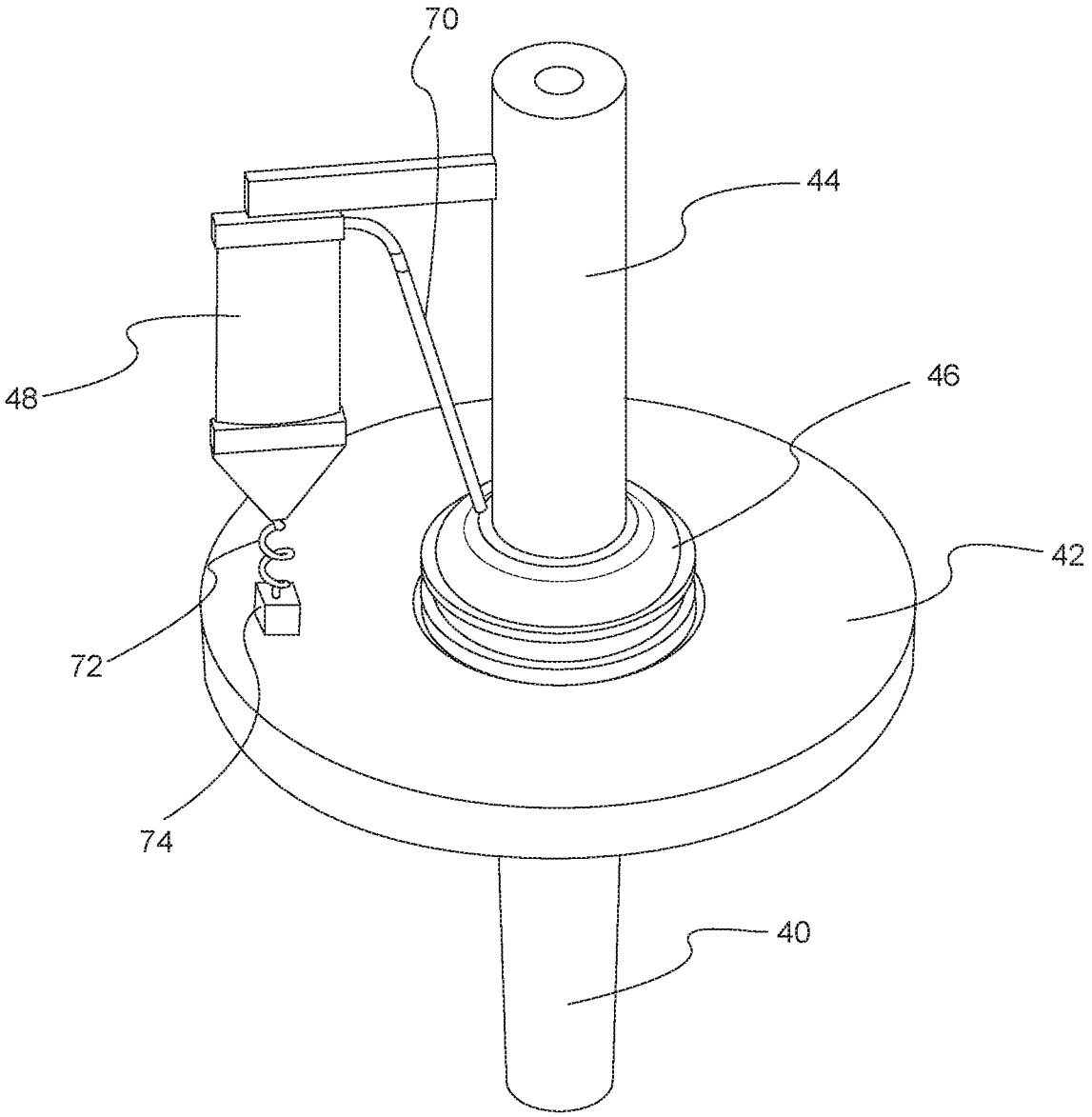
FIG. 10 is a perspective view of a mold for use in the counter-gravity casting apparatus of FIG. 1 in accordance with yet another alternative aspect of the disclosure.
Figure 11:
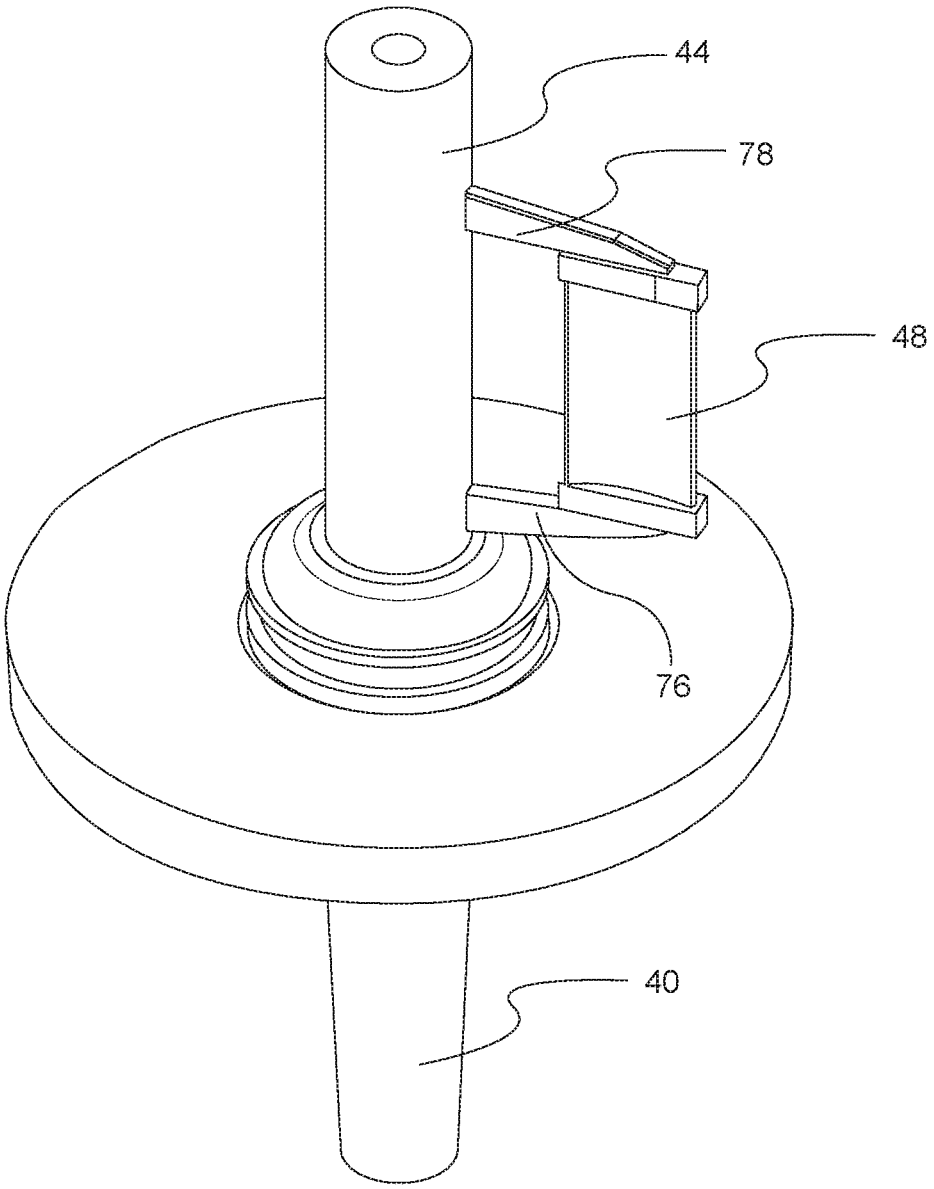
FIG. 11 is a perspective view of a mold for use in the counter-gravity casting apparatus of FIG. 1 in accordance with yet another alternative aspect of the disclosure.

In the alternate embodiment shown in FIG. 10, the molten alloy is drawn through a fill tube 70 into the top of the mold 48. The mold is constructed to produce directionally solidified or single crystal grains. In yet another mechanism the molten metal rises through the center sprue 44 and enters the mold 48 near the bottom of the mold through a lower feed branch 76, as shown in FIG. 11. The mold is constructed to produce equiaxed polycrystalline grains. Additional molten alloy is introduced into the top of the mold 48 through an upper feed branch 78 to fill shrinkage. A reduction in inclusions can be achieved by bottom filling the mold in a non-turbulent fashion in the foregoing manner. In addition, consistent mold temperature control arising from the use of the susceptor 50 to heat the mold can reduce defects such as shrinkage porosity, gas, non-fill and cold shut, and improve quality of the casting.

The melt chamber 12, fill chamber 14, casting chamber 16 and susceptor chamber 18 are connected by inlet 60, 62, 64 to inert gas tanks (not shown). Typically ultra-high purity argon is used. In one aspect of the disclosure, vacuum melting and argon assisted filling of gas impervious and pervious ceramic molds is employed.

In an aspect of the disclosure, the chill plate 42 and the base plate 22 will have a recessed hole 1" to 5" in diameter in the center. A gasket approximately 0.040" to 0.120" in thickness and an inner diameter slightly greater than the diameter of the recessed chill plate hole is placed on the recessed hole. The fill pipe 40, which is preferably made from a ceramic and pre-heated to a temperature up to 2100 degrees Fahrenheit, with an outer diameter slightly less than that of the recessed hole, is inserted into the hole in the chill plate 42. A gasket is then placed on top of the collar of the fill pipe. The preheated ceramic mold, made from commonly used materials such as alumina and assembled with a ceramic collar, is placed on the gasket. The ceramic mold is typically preheated to a temperature up to 2100 degrees Fahrenheit before it is transferred on to the chill plate 42.

In an aspect of the disclosure, the susceptor 50 inside the casting or mold chamber 16 has an inner diameter slightly larger than the diameter of the chill plate 42. The susceptor 50 is lowered over the preheated mold 48. The mold chamber door 68 is closed and a vacuum is drawn on the mold chamber 16. The susceptor 50 is switched on once a vacuum level of less than ten millitorr is achieved in the mold chamber. The susceptor 50 is heated using any standard technique used in making single crystal, directionally solidified castings. The melt chamber 12, fill chamber 14 and casting chamber 16 are held under less than ten millitorr vacuum, while the alloy is melted and the mold is heated to the casting temperature using the susceptor 50.

In an aspect of the disclosure, the susceptor 50 inside the casting or mold chamber 16 has an inner diameter slightly larger than the diameter of the chill plate 42. The susceptor 50 is preheated to a temperature up to 2100 Fahrenheit. Preheated mold 48 is placed under the susceptor 50. The mold chamber door 68 is closed and a vacuum is drawn on the mold chamber 16. Once a vacuum level of less than ten millitorr is achieved in the mold chamber, the interlock between the mold and susceptor chambers 16, 18 is removed, the susceptor 50 is switched on and the susceptor 50 is lowered over the preheated mold 48. The susceptor 50 is heated using any standard technique used in making single crystal, directionally solidified castings. The melt chamber 12, fill chamber 14, casting chamber 16 and susceptor chamber 18 are held under less than ten millitorr vacuum, while the alloy is melted and the mold is heated to the casting temperature using the susceptor 50.

In one aspect of the disclosure, when the mold 48 is ready to cast, the crucible 28 is moved up to an intermediate position so that it is pressed against the O-ring on the bottom of the base plate 22. In doing so the fill pipe 40 is inserted into the molten alloy 32. Pressure on the molten metal is then increased at a predetermined rate, called the rate of rise (ROR) up to 1 atmosphere in two to sixty seconds, by pumping argon into the fill chamber 14 but not the casting chamber 16. The pressure differential between the fill chamber 14 and the casting chamber 16 introduces the molten metal into the mold via the ceramic fill pipe 40. The pressure is increased until the entire mold cavity 48 is filled.

Once the mold cavity 48 is filled the pressure is held constant for up to 600 seconds. Application of pressure to the liquid metal during mold fill results in better fill out of the intricate details on the casting surface. The method described in the foregoing aspect of the disclosure is useful in casting nickel based superalloys used to cast single crystal and directionally solidified parts such as blades and vanes. The process can be run without using the filters which are used in the traditional directionally solidified single crystal casting processes to filter the oxides that arise from turbulent flow. By controlling the ROR this process can reduce the turbulence and hence oxides.

In an aspect of the disclosure, the process of mold withdrawal from the susceptor 50 is achieved by moving the susceptor 50 up in the vertical direction. The molten alloy 32 that came in contact with the chill plate 42 will freeze and create the required seed grains that will grow into the mold cavity 48. In one aspect of the disclosure, the pressure in the fill chamber and the casting chamber are equalized after the grain block and grain selector have solidified to create single crystal directionally solidified parts. In an alternate aspect of the disclosure, the pressure in the fill chamber and the casting chamber are equalized after the liquid metal in the mold has solidified to create equiaxed polycrystalline parts.

When the susceptor 50 moves past the top of the fill pipe 40 the pressure inside the crucible 28 is released and the crucible 28 is lowered and translated back to its initial position. In the case as shown in FIG. 10, as soon as the mold 48 is filled with liquid metal, the pressure inside the crucible 28 is released and the crucible 28 is lowered and translated back to its initial position. The interlock 20 between the fill chamber 14 and melt chamber 12 is closed, the crucible 28 is recharged with alloy, and vacuum drawn on the crucible 28 before the charge is melted for casting the next mold. Once the withdrawal cycle is completed the casting chamber 16 is opened and the solidified mold removed from the chill plate for further processing.

In another aspect of the disclosure that is well suited for casting highly reactive single crystal, directionally solidified alloys, the melt chamber 12, fill chamber 14, casting chamber 16 and susceptor chamber 18 are connected to vacuum pumps via inlets 60, 62, 64 as well as being connected to inert gas tanks. Typically, ultra-high purity argon is used. In this aspect of the disclosure, the graphite susceptor 50 is lowered over the preheated mold 48 and the mold chamber door 68 is closed. A vacuum is drawn on the mold chamber 16 and the susceptor 50 is switched on once a vacuum level of less than ten millitorr is achieved in the mold chamber 16. The susceptor 50 is heated using standard techniques used in making single crystal, directionally solidified castings. The melt chamber 12, the fill chamber 14, the mold chamber 16 and the susceptor chamber 18 are held under less than ten millitorr vacuum, while the alloy 32 is melted and the mold 48 is heated to the casting temperature using a susceptor 50.

When the mold is ready to cast, the crucible 28 is moved up to an intermediate position so that it is pressed against the O-ring on the bottom of the base plate. In doing so the fill pipe 40 is inserted into the molten alloy 32. Both the mold chamber 16 and the fill chamber 14 are pressurized with argon up to one atmosphere pressure. Once the pressure is reached in all chambers, the argon from the mold chamber 16 is removed at a rate of up to 1 atmosphere in two seconds to sixty seconds, thus creating a vacuum in the mold chamber 16 which forces the liquid metal from the crucible 28 to fill the mold cavity 48 via the fill pipe 40. Once the mold cavities are filled the vacuum is held constant for up to 800 s.

The mold 48 is then withdrawn from the susceptor 50 by moving the susceptor 50 up in the vertical direction. The molten alloy 32 that came in contact with the chill plate 42 will freeze. The crucible 28 is lowered back to the intermediate position and transferred back to its initial position in the melt chamber 12. When the susceptor 50 moves past the top of the part being cast the pressure inside the mold chamber 16 is increased up to one atmosphere. The susceptor 50 raising is continued and the interlock 20 between the two parts of the fill chamber 14 and the melt chamber 12 is closed, the crucible 28 is recharged with alloy, vacuum drawn on the crucible 28, and the charge is melted for casting the next mold 48. Once the withdrawal cycle is completed the mold chamber 16 is opened and the solidified mold is removed from the chill plate 42 for further processing.

It will be readily recognized that the foregoing described methods and systems result in a reduction in the overall height of the shell mold as there is no need for a pour cup. As a result, a reduced amount of shell material is needed to build the shell mold reducing the cost of making the mold and reducing the waste material generated by the casting process. In aspects of the present disclosure, the feeder length is shorter than the traditional gravity casting methods and thus also uses less metal. In addition to the foregoing, another benefit achieved in various aspects of the disclosure are a reduction in spurious grains during the withdrawal process for single crystal parts because the mold is held stationary. Using a plunger to hold the mold in place during mold filling eliminates the need for using clamps on the mold bottom to avoid mold lifting.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The invention claimed is:

1. A counter-gravity casting apparatus, comprising:

a melt chamber;

a fill chamber adjacent to and displaced lateral to the melt chamber with respect to gravity;

a casting chamber positioned above the fill chamber with respect to gravity;

a fill pipe positioned within the fill chamber;

a susceptor located within the casting chamber, said susceptor configured to move vertically in relation to a mold which is fixed in place during casting; and a susceptor coil surrounding the susceptor and configured to heat the susceptor.

2. The counter-gravity casting apparatus of claim 1, further comprising a plunger positioned to secure in position a mold placed in the casting chamber.

3. The counter-gravity casting apparatus of claim 1, further comprising a susceptor chamber located above the casting chamber and wherein the susceptor is moveable between the casting chamber and the susceptor chamber.

4. The counter-gravity casting apparatus of claim 3, further comprising a first interlock between the melt chamber and the fill chamber.

5. The counter-gravity casting apparatus of claim 4, further comprising a second interlock between the casting chamber and the susceptor chamber.

6. The counter-gravity casting apparatus of claim 5, further comprising pressurization inlets for controlling a pressure differential between the fill chamber and the casting chamber.

7. The counter-gravity casting apparatus of claim 6, further comprising a carriage for translating a crucible from the melt chamber to the fill chamber.

* * * * *